United States Patent [19]

Lenack et al.

[11] 4,387,033

[45] Jun. 7, 1983

[54] CALCIUM SULPHONATE PROCESS

[75] Inventors: Alain L. Lenack, Le Mesnil Esnard; Robert Tirtiaux, Mont Saint Aignan, both of France

[73] Assignee: Exxon Research & Engineering Co., Florham Park, N.J.

[21] Appl. No.: 293,861

[22] Filed: Aug. 18, 1981

[30] Foreign Application Priority Data

Aug. 29, 1980 [GB] United Kingdom ..... 8028077

[51] Int. Cl.[3] ..... C10M 1/40

[52] U.S. Cl. ..... 252/18; 252/25; 252/33.4

[58] Field of Search ..... 252/18, 25, 33.4

[56] References Cited

U.S. PATENT DOCUMENTS

| | | | |
|---|---|---|---|
| 3,609,076 | 9/1971 | Sabol et al. | 252/18 |
| 3,816,310 | 6/1974 | Hunt | 252/33.4 |
| 3,830,739 | 8/1974 | Kemp | 252/33.4 |

*Primary Examiner*—Jacqueline V. Howard
*Attorney, Agent, or Firm*—J. J. Mahon

[57] ABSTRACT

In producing basic Calcium Sulphonate by carbonating mixtures of sulphonic acids, calcium hydroxide, alcohols and toluene the use of a narrowly defined temperature profile during carbonation enables product of improved oil solubility and viscosity to be obtained as well as leading to improved filterability.

6 Claims, 1 Drawing Figure

Figure 1:
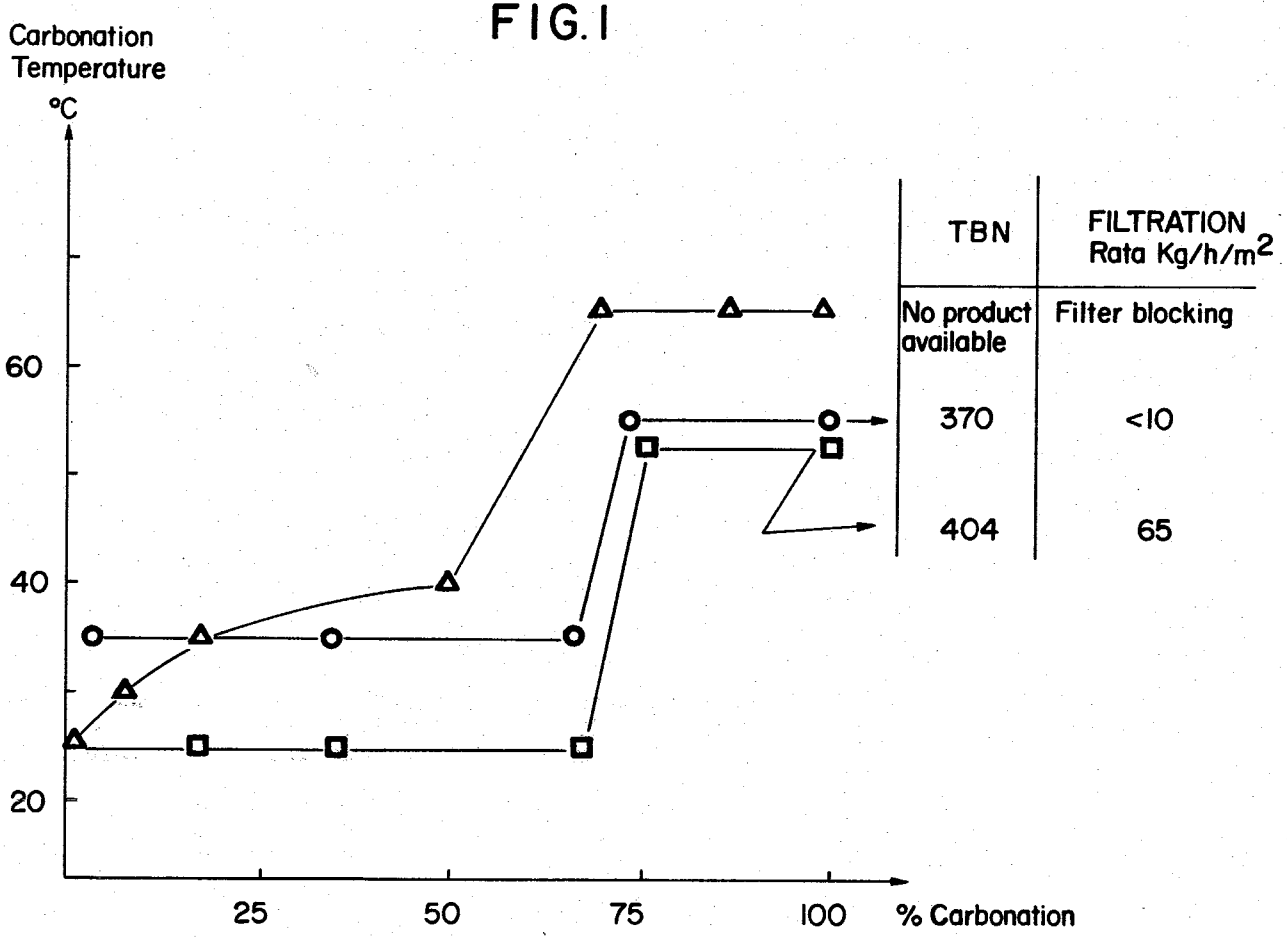

| TBN | FILTRATION Rata Kg/h/m$^2$ |
|---|---|
| No product available | Filter blocking |
| 370 | <10 |
| 404 | 65 |

CALCIUM SULPHONATE PROCESS

The present invention relates to an improved process for the production of highly basic calcium sulphonate.

Highly basic calcium sulphonate is a common component in lubricating oils, the materials generally comprising colloidal calcium carbonate dispersed in an oil. The sulphonate acting as the surfactant to disperse the calcium carbonate in the oil. When used as an additive for an automotive crank-case lubricant the highly basic element neutralises acids formed during operation of the engine and the surfactant helps to inhibit the sludge that forms in the oil from settling to the bottom of the oil.

Highly basic calcium sulphonates are generally produced by carbonating an oil solution of a sulphonic acid, a reaction solvent, a stoichiometric excess (over that required to react with the sulphonic acid) of a calcium compound, usually calcium oxide or calcium hydroxide and certain reaction promoters such as lower alcohols, especially methanol and/or calcium chloride. If desired the calcium compound may be pre-reacted with the sulphonic acid.

Economically it is useful to obtain a product which is as highly basic as possible so that as little as possible may be used in the oil to give the desired basic effect. However, as one tries to increase the basicity of the product the viscosity of the reaction mixture increases undesirably and the ability to filter the product at an acceptable rate reduces. Furthermore the solubility of the calcium sulphonate in oil reduces leading to an unacceptably hazy lubricant. The present invention is concerned with improving the filterability and viscosity of calcium sulphonate and to producing 400 Total Base Number (TBN) (ASTM D644) calcium sulphonate with acceptable filterability and viscosity.

Overbased calcium sulphonates are generally produced by carbonating mixtures of an oil soluble sulphonic acid or an alkaline earth metal sulphonate, an alcohol, often methanol, calcium oxide and oil. In some processes second solvents, promoters and alkaline earth metal halides are used. Processes for the production of overbased calcium sulphonates are described in British Patent specification Nos. 1299253 and 1309172.

U.S. Pat. No. 3,830,739 issued Aug. 20, 1974 to Kemp discloses a hyperbasic process for calcium sulfonates which uses two-step carbonation with a first carbonation step below 35° C. Among other distinctions with regard to this invention, U.S. Pat. No. 3,830,739 does not require water as a critical ingredient and carries out the final carbonation step after stripping of volatiles.

We have now found that calcium sulphonate of acceptable viscosity which can be filtered at the required rate and which has good solubility may be obtained by using a process which employs a carefully controlled temperature profile during the carbonation reaction in combination with other critical steps. Furthermore we have found that this process allows calcium sulphonate of approximately 400 TBN to be obtained.

In accordance with the present invention there has been discovered a process for the production of a highly basic dispersion of calcium sulfonate in lubricating oil which comprises the steps of:

(a) providing a reaction mixture of (i) $Ca(OH)_2$ (ii) an oil-soluble sulfonic acid or calcium sulfonate in an amount of from 40 wt.% to 220 wt. % based upon the weight of calcium hydroxide, (iii) 70 wt. % to 120 wt.% of a $C_1$ to $C_4$ monohydric alkanol based on the weight of calcium hydroxide, (iv) 150 to 200 wt.% of a volatile aromatic hydrocarbon solvent, based on the weight of calcium hydroxide, and (v) 3 wt.% to 10 wt.% of water based upon the weight of $Ca(OH)_2$; and (b) in a first carbonation step carbonating said reaction mixture with $CO_2$ at a temperature of about 25° C. to 30° C. with 0.5 to 0.8 moles of $CO_2$ relative to the moles of $Ca(OH)_2$; and (c) increasing the temperature of the reaction mixture to between 45° C. and 100° C; and (d) in a second carbonation step carbonating the reaction mixture at said increased temperature with $CO_2$ (e) removing volatiles from said reaction mixture The sulfonic component of the reaction mixture includes oil-soluble sulphonic acids and these may be a natural or synthetic sulphonic acid, e.g. a mahogany or petroleum alkyl sulphonic acid; an alkyl sulphonic acid; or an alkaryl sulphonic acid. The alkyl sulphonic acid should preferably have at least 18 carbon atoms in the alkyl chain. Most suitable are alkaryl sulphonic acids having a molecular weight of between 300 and 700, e.g. between 400 and 500, such as alkyl benzene and alkyl toluene sulfonic acids. Particularly preferred sulphonic acids are those prepared by sulphonating benzene or toluene that has been alkylated with $C_{18}$ to $C_{36}$ olefines which may be branched or straight chain or mixtures thereof.

Instead of a sulphonic acid, an alkaline earth metal sulphonate can be used for example a calcium sulphonate, but sulphonic acids are preferred.

The sulfonic acid or sulfonate can be conveniently used as a mineral oil solution, e.g. one consisting of 70% by weight of sulphonic acid or sulphonate and 30% by weight of oil and the presence of this oil in the reaction mixture may be an added advantage.

The alkanol is peferably methanol although other alcohols such as ethanol can be used.

The volatile hydrocarbon solvent of the reaction mixture is preferably a normally liquid aromatic hydrocarbon having a boiling point not greater than about 150° C. Aromatic hydrocarbons have been found to give improved filtration rates, and examples of suitable solvents are toluene, xylene, and ethyl benzene.

Additional reaction promoters may be used and these may be the ammonium carboxylates such as those described in U.K. Pat. No. 1307172 where the preferred ammonium carboxylates are those derived from $C_1$ to $C_3$ saturated monocarboxylic acids, e.g. formic acid, acetic acid, or propionic acid. The preferred ammonium carboxylate is ammonium formate.

Alternatively alkali metal salts of a $C_1$ to $C_3$ carboxylic acid may be used as promoters, the preferred materials being those of $C_1$ to $C_3$ saturated monocarboxylic acids. The preferred alkali metals are sodium and potassium.

As an alternative promoter a metal halide or sulphide may be used. The preferred metals are alkali metals or alkaline earth metals, e.g. sodium, potassium, lithium, calcium, barium, strontium. Other metal nitrates or sulphides which may be used are those of aluminium, copper, iron, cobalt, nickel.

The water content of the initial reaction mixture is important to obtaining the desired product and is preferably not more than 10 wt. % and not less than 3 wt.% preferably not less than 4 wt.% based on the weight of calcium hydroxide used. The reactants which are used are therefore preferably anhydrous, and this includes carbon dioxide and any calcium hydroxide which is added later to the reaction mixture or if not the water level must be adjusted after formation of the reaction mixture to allow for water in the components and also water formed by neutralisation of the sulphonic acid in particular allowance must be made for any water present in the sulphonic acid.

Oil may be added to the reaction mixture and if so suitable oils including hydrocarbon oils, particularly those of mineral origin. Oils which have viscosities of 15 to 30 cs at 100° F. are very suitable. Alternatively other oils which may be used are the lubricating oils which are described later in the specification.

The preferred quantities of components will depend upon the desired TBN of the product. It is essential that the ratio of alkanol and hydrocarbon solvent be such that this mixture consists of 30% to 80 wt % of alkanol and 70% to 20 wt % hydrocarbon solvent. If there is too much alkanol the resulting product will be greasy, whereas with too much of hydrocarbon solvent there will be excessive viscosity of the reaction mixture whilst carbon dioxide and any calcium hydroxide are added. Preferred ratios are between 50% to 70 wt % hydrocarbon solvent, and 50 wt % to 30 wt % alkanol, based upon the combined weight of these two volatiles.

If a promoter is used we prefer to use less than 10%, e.g. between 3.0% and 7.0% by weight based on the total weight of calcium hydroxide in the reaction mixture, including any calcium hydroxide which is added at a later stage in the reaction. In the production of a 300 TBN product we prefer to use about 120 wt % of sulphonic acid based on the weight of calcium hydroxide whereas for a 400 TBN product 65 wt % is preferred. Similarly the preferred quantity of water depends upon the desired TBN.

The calcium hydroxide may be added in several batches and if so we prefer that the weight of each charge is preferably between 20 and 30% by weight based on the weight of sulfonic acid or sulfonate and any oil that may be present. In the production of a 400 TBN product the $Ca(OH)_2$ is preferably added in at least two stages with the second charge being introduced after the step (b) and the second charge being about 75 wt % to 150 wt % of that used in step (a).

If desired more than two additions of calcium hydroxide followed by carbon dioxide addition may be carried out using similar reaction conditions as with the previous addition. For adding calcium hydroxide in a further addition step, the carbon dioxide treatment at the previous step does not need to be complete, i.e. the reaction mixture should be still capable of absorbing more carbon dioxide. It is preferred that at least 30 wt % of the carbon dioxide be introduced before further addition of calcium hydroxide.

After the last treatment with carbon dioxide, the reaction mixture should be heated to an elevated temperature, e.g. above 130° C., to remove volatile materials (water, and any remaining alcohol and solvent) and thereafter filtered, preferably using a filter aid, generally it is necessary to heat to temperature above about 130° C. to complete removal of the volatiles although significant quantities are removed below this temperature. The products are generally used as an oil solution and so if there is insufficient oil present in the reaction mixture to retain an oil solution after removal of the volatiles oil should be added after completion of distillation or during removal of the volatiles, the amount of oil added being sufficient to retain the highly basic calcium sulphonate as an oil solution. The desired overbased detergent additive usually having a TBN (ASTM D2896) of 300 or more, preferably 390–410, is the filtrate.

As a further preferred embodiment of the process water is added to the reaction mixture just before introduction of carbon dioxide or during the introduction of the first 5% of the total amount of carbon dioxide that is injected. The water is then removed when the other volatiles are removed but we find that this addition of water reduces the tendency of the product to form a skin on storage, and considerably improves the filterability of the sulfonate.

As a modification the above described process can be varied by including in the reaction mixture a sixth component and that is a long-chain monocarboxylic acid, or anhydride, or a long-chain di-carboxylic acid or anhydride. By long-chain we mean that the molecular weight of the acid is at least 500. Preferred carboxylic acids are those having a molecular weight of between 600 and 3000, e.g. between 800 and 1800. These carboxylic acids are conveniently derived from a polymer of a mono-olefin, e.g. a. $C_2$ to $C_5$ mono-olefin, such as polyethylene, polypropylene and polyisobutene.

When used the quantity is preferably 20 to 55wt % of the weight of sulfonic acid or sulfonate such that the combined weight of the two are then preferably 18 to 100% by weight of the total weight of oil plus sulfonic acid or sulfonate in the reaction mixture.

Also as a further modification, to minimise the production of greasy products, the reaction mixture can also include small amounts (e.g. between 2 and 7% by weight based on the sulfonic acid or sulfonate and any oil present) of an alkyl phenol containing at least 7 carbon atoms in the alkyl chain. Suitable examples are n-decyl phenol, cetyl phenol, and nonyl phenol. Alkyl phenols act as copromoters and also enhance the speed of reaction.

The overbased detergent of this invention is suitable for use in lubricating oils, both mineral and synthetic. The lubricating oil may be an animal, vegetable or mineral oil, for example petroleum oil fractions ranging from naphthas to spindle oil to SAE 30, 40 or 50 lubricating oil grades, castor oil, fish oils or oxidised mineral oil.

Suitable synthetic ester lubricating oils include diesters such as di-octyl adipate, dioctyl sebacate, didecyl azelate, tridecyl adipate, didecyl succinate, didecyl glutarate and mixtures thereof. Alternatively the synthetic ester can be a polyester such as that prepared by reacting polyhydric alcohols such as trimethylol-propane and pentaerythritol with monocarboxylic acids such as butyric acid, caproic acid, caprylic acid and pelargonic acid to give the corresponding tri- and tetra-esters.

Also complex esters may be used as base oils such as those formed by esterification reactions between a dicarboxylic acid, a glycol and an alcohol and or a monocarboxylic acid.

Blends of diesters with minor proportions of one or more thickening agents may also be used as lubricants. Thus one may use blends containing up to 50% by volume of one or more water insolubule polyoxylakylene glycols, for example polyethylene or polypropylene glycol, or mixed oxyethylene/oxypropylene glycol.

The amount of overbased detergent added to the lubricating oil should be a minor proportion, e.g. between 0.01% and 10% by weight, preferably between 0.1% and 5% by weight.

The final lubricating oil may contain other additives according to the particular use for the oil. For example, viscosity index improvers such as ethylene propylene copolymers may be present as may succinic acid based dispersants, other metal containing dispersant additives and the well known zinc dialkyldithiophosphate antiwear additives.

The present invention is illustrated but in no way limited by reference to the following Examples

EXAMPLE 1

180 g of Ca $(OH)_2$ are dispersed in 275 g of methanol in a 2 liter vessel. A solution of 290 g of $C_{24}$ alkyl benzene sulphonic acid at 70 mass % active ingredient in oil in 600 g of toluene is poured into the reactor. The temperature is held in the range 25° to 30° C. whilst 25 g of water are added and carbonation is started. $CO_2$ is injected at 25 g/h; the temperature in the reactor is maintained at 25° C. When 75 g of $CO_2$ have been injected, 130 g of $Ca(OH)_2$ are added to the reactor without stopping the $CO_2$ injection. When 100 g of $CO_2$ have been injected the temperature is raised quickly to 50° C. and 50 g of $CO_2$ added at 25 g/h at this temperature. $CO_2$ injection is stopped and the mixture stirred for 1 hour at 50° C. During all the process, $Ca(OH)_2$ is in excess versus the $CO_2$ injected. 360 g of diluent oil are added and the mixture hedated to remove volatile matter. Finally nitrogen stripping is carried ou at 150° C. under reduced pressure and 45 g of the filter aid CLARCEL DCB added and the product filtered through a Buchner of 144 $cm^2$. The characteristics of the product are given in Table 1, column H.

EXAMPLE 2

Example 1 is repeated varying the amount of $CO_2$ injected at 25° C. and 50° C. and the quantity of water added. The results (Table 1) of columns A–E are for comparison with the results in accordance with the invention represented by columns F–J, showing the benefits in viscosity, filterability and appearance achieved using the process of the invention, the results are also illustrated in the attached FIG. 1.

EXAMPLE 3

The following reactants were charged to a 2 liter vessel

| | Grams |
|---|---|
| Sulphonic Acid | 304 |
| Toluene | 600 |
| Methanol | 275 |
| $Ca(OH)_2$ (initial charge) | 180 |
| $Ca(OH)_2$ (added after 3 hrs $CO_2$) | 130 |
| Water | 21 |

The mixture was held at 25° C. whilst 100 grams of carbon dioxide were injected over 4 hours. The temperature was allowed to rise to 45° C. over half an hour whilst a further 12.5 grams of carbon dioxide were injected. The mixture was then held at 45° C. for 1.3 hours whilst a further 32.5 grams of carbon dioxide were injected. 344 grams of diluent oil were then added and the volatile materials distilled off at between 80° and 100° C. whilst blowing with $CO_2$.

Finally, the product was filtered at 91.8 kg $hr^{-1} m^{-2}$ to give a product having the following characteristics:

| | |
|---|---|
| Appearance | Slightly hazy |
| TBN, mg KOH $g^{-1}$ | 413 |
| —OH base no. mg KOH $g^{-1}$ | 8.7 |
| 5% in Stanco 600 | Hazy 0.1% flocculent ppt |
| 3 weeks at room temp. | |
| Kin. Visc. at 100° C., cST | 44.6 |
| Sediment (24 hrs extended), vol % | Nil |
| IR spectrum | $CaCO_3$ all in amorphous form (860 $cm^{-1}$) |

TABLE 1

| | A | B | C | D | E | | F | G | H | I | J |
|---|---|---|---|---|---|---|---|---|---|---|---|
| CHARGE OF RAW MATERIALS (grams) | | | | | | | | | | | |
| Methanol | ← | ← | ← | ← | ← | 275 | → | → | → | → | → |
| $Ca(OH)_2$ | ← | ← | ← | ← | ← | 180 | → | → | → | → | → |
| Toluene | ← | ← | ← | ← | ← | 600 | → | → | → | → | → |
| Sulphonic Acid | ← | ← | ← | ← | ← | 290 | → | → | → | → | → |
| $H_2O$ | 0 | 0 | 0 | 0 | 0 | | 10 | 20 | 25 | 30 | 35 |
| CARBONATION CONDITIONS (grams) | | | | | | | | | | | |
| $CO_2$ injected at 25° C. | | 75 | 100 | 125 | 140 | | 100 | 100 | 100 | 100 | 100 |
| $CO_2$ injected at 50° C. | 150 | 75 | 50 | 25 | 0 | | 50 | 50 | 50 | 50 | 50 |
| $Ca(OH)_2$ (after 75g $CO_2$ injected) | ← | ← | ← | ← | ← | 150 | → | → | → | → | → |
| PRODUCT CHARACTERISTICS | | | | | | | | | | | |
| Appearance | B & C* | B & C | B & C | B & C | | | B & C | B & C | B & C | Slightly Hazy | Hazy |
| TBN, mg KOH/g | 354 | 399 | 397 | 395 | | | 402 | 400 | 404 | 399 | 409 |
| Phenol phthalein alkalinity, mg KOH/g | 27 | 41 | 34 | 38 | | | 27 | 26 | 24 | 30 | 35 |
| Blend at 5% in SB 600 | Clear | Clear | Clear | Clear | | | Clear | Clear | Clear | Hazy | Hazy |
| Viscosity at 100° C., cSt | 60 | 96 | 56 | 72 | | | 51 | 45 | 46 | 48 | 48 |
| Filtration rate, min (time to filter 100g) | >30 | >30 | 13.5 | 7 | | | 12 | 10 | 7.5 | 6.5 | 2 |

*Bright & Clear

What we claim is:

1. A method for the production of an overbased calcium sulphonate having a total base number of about 390 to 410 of improved filterability and viscosity which comprises the steps of (a) providing a reaction mixture of (i) $Ca(OH)_2$ (ii) an oil-soluble sulfonic acid or calcium sulfonate in an amount of from 40 wt% to 220 wt% based upon the total weight of calcium hydroxide, (iii) 70 wt% to 120 wt% of a $C_1$ to $C_4$ monohydric alkanol based on the total weight of calcium hydroxide, (iv) 150 to 200 wt% of a volatile aromatic hydrocarbon solvent, based on the total weight of calcium hydroxide, and (v) 3 wt% to 10 wt% of water based upon the total weight of $Ca(OH)_2$, said total weight of $Ca(OH)_2$ being the amount added in steps (a) and (b); and in a first carbonation step carbonating said reaction mixture with $CO_2$ at a temperature of about 25° C. to 30° C. with 0.5 to 0.8 moles of $CO_2$ relative to the moles of $Ca(OH)_2$ and adding aditional $Ca(OH)_2$ in an amount equal to 75 wt% to 150 wt% of that used in step (a); and (c) increasing the temperature of the reaction mixture to between 45° C. and 100° C.; and (d) in a second carbonation step carbonating the reaction mixture at said increased temperature with $CO_2$ removing volatiles from said reaction mixture.

2. The method of claim 1 wherein the reaction mixture further comprises a reaction promoter in an amount of from about 3.0 to 7.0% by weight based upon the weight of calcium hydroxide in the reaction mixture.

3. The method of claim 1 wherein the sulfonic acid or sulfonate is an alkaryl sufonic acid having a molecular weight of 300 to 700.

4. The method of claim 1 wherein the alkanol is methanol.

5. The method of claim 1 wherein the volatile hydrocarbon solvent is toluene.

6. A process according to claim 1 in which 65 wt% to 120 wt% of sulphonic acid is used based on the total weight of calcium hydroxide use.

* * * * *